US008797122B2

(12) United States Patent
Lee et al.

(10) Patent No.: US 8,797,122 B2
(45) Date of Patent: Aug. 5, 2014

(54) BUTLER MATRIX

(75) Inventors: Hongyeol Lee, Chungcheongbuk-do (KR); Man Seok Uhm, Daejeon (KR); So-hyeun Yun, Daejeon (KR); ChangSoo Kwak, Daejeon (KR); Jang-sup Choi, Daejeon (KR); In Bok Yom, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 13/609,606

(22) Filed: Sep. 11, 2012

(65) Prior Publication Data

US 2013/0076565 A1 Mar. 28, 2013

(30) Foreign Application Priority Data

Sep. 22, 2011 (KR) ..... 10-2011-0095920

(51) Int. Cl.
*H01P 5/12* (2006.01)
*H01Q 3/00* (2006.01)

(52) U.S. Cl.
USPC ..... 333/117; 342/373

(58) Field of Classification Search
USPC ..... 333/116, 117; 342/372, 373, 374
See application file for complete search history.

(56) References Cited

U.S. PATENT DOCUMENTS 5,134,417 A 7/1992 Thompson
5,274,839 A * 12/1993 Kularajah et al. ..... 455/12.1
5,610,617 A * 3/1997 Gans et al. ..... 342/373
7,969,359 B2 6/2011 Krishnaswamy et al.

FOREIGN PATENT DOCUMENTS

JP 08-250923 A 9/1996
JP 2957027 B2 10/1999

OTHER PUBLICATIONS

B. Piovano, et al; "Cad and Mechanical Realization of Planar, Ka0Band 8×8 Butler Matrices", 32nd European Microwave Conference, 2002., Sep. 23-26, 2002, pp. 1-4.
B. Piovano, et al; "Design and Breadboarding of Wideband N×N Butler Matrices for Multiport Amplifiers", SBMO International Microwave Conference/Brazil, 1993; Aug. 2-5, 1993; vol. 1, pp. 175-180.

* cited by examiner

*Primary Examiner* — Dean O Takaoka
(74) *Attorney, Agent, or Firm* — Ladas & Parry LLP

(57) ABSTRACT

A butler matrix includes at least one input coupler that is positioned at an input end of the butler matrix, receives an input signal, and divides and outputs it to a plurality of paths, and at least one output coupler that receives a signal from the input coupler and divides the signal into a plurality of paths to output it as an output signal. A separation coupler is formed in an intersecting path including an intersecting section at which transmission paths intersect among a plurality of paths through which a signal is transmitted to separate signals transmitted through different transmission paths. Further, a compensation coupler is formed in a path excluding the intersecting path to compensate a phase difference.

17 Claims, 7 Drawing Sheets

BUTLER MATRIX

CROSS-REFERENCE TO RELATED APPLICATION

This application claims priority to and the benefit of Korean Patent Application No. 10-2011-0095920 filed in the Korean Intellectual Property Office on Sep. 22, 2011, the entire contents of which are incorporated herein by reference.

BACKGROUND OF THE INVENTION (a) Field of the Invention

The present invention relates to a butler matrix.

(b) Description of the Related Art

A butler matrix of a passive element is used in a multiple terminal amplifier to divide an input signal into N input signals or to combine N input signals with an output terminal. A micro-strip line, a strip line, a coaxial line, a wave guide, or others may be used in the butler matrix according to the amplitude of a signal. For the power distribution and power coupling, a 3 dB coupler is used in the butler matrix. Four 3 dB couplers are used in a 4×4 butler matrix and twelve 3 dB couplers are used in an 8×8 butler matrix.

However, the larger the degree of the butler matrix is, the larger the number of 3 dB couplers is, and thereby the path for connecting the couplers becomes more complicated and a part where transmission lines are crossed necessarily occurs. The crossed transmission lines have to be designed to be electrically or spatially separated.

For this purpose, there is a butler matrix of a structure in which micro-strip lines or strip lines are laminated. However, in this structure, a radio frequency (RF) signal of high power may not be transmitted through a transmission line such as the micro-strip lines or the strip lines.

Also, when a transmission line that is difficult to laminate such as a coaxial line or a wave guide is used, a 3-dimensional (3D) form of butler matrix is implemented by bending transmission lines that cross each other and by spatially separating them.

However, it is difficult to manufacture the 3D form of butler matrix and electrical loss may occur. In addition, if the degree of the butler matrix increases, the structure of the butler matrix becomes more complicated. This enlarges the volume of the butler matrix, and thereby it is difficult to manufacture the butler matrix.

Meanwhile, a planar type of butler matrix is implemented by electrically dividing signals in the part in which transmission lines are crossed with a 0 dB coupler. In this case, a phase difference between a transmission line with a 0 dB coupler and a transmission line without a 0 dB coupler occurs. Accordingly, an expensive phase shifter has to be used to compensate the phase difference.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a butler matrix in which crossed transmission lines are spatially or electrically separated.

Also, the present invention has been made in an effort to provide a butler matrix have advantage of compensating phase delay with a coupler.

An exemplary embodiment of the present invention provides a butler matrix. The butler matrix includes: at least one input coupler that is positioned at an input end of the butler matrix, receives an input signal, and divides and outputs it to a plurality of paths; at least one output coupler that receives a signal from the input coupler and divides the signal into a plurality of paths to output it as an output signal; a separation coupler that is formed in an intersecting path including a intersecting section at which transmission paths intersect among a plurality of paths through which a signal is transmitted between the input coupler and the output coupler, and separates signals transmitted through different transmission paths; and a compensation coupler that is formed in a path excluding the intersecting path among the plurality of paths and compensates a phase difference between a signal transmitted through the intersecting path and a signal transmitted through the path excluding the intersecting path.

Another embodiment of the present invention provides a butler matrix. The butler matrix includes: a plurality of input couplers that are positioned at an input end of the butler matrix, receive an input signal, and divide and output it to a plurality of paths; a plurality of output couplers that receive a signal from the input coupler and divide the signal into a plurality of paths to output it as an output signal; a plurality of transmission couplers that are respectively formed between the plurality of input couplers and the plurality of output couplers to transmit a signal output from the input coupler to the output coupler; a plurality of separation couplers that are respectively formed in intersecting paths including an intersecting section at which transmission paths intersect among a plurality of paths through which a signal is transmitted between the input coupler and the output coupler, and separate signals transmitted through different transmission paths; and a plurality of compensation couplers that compensate phase delays with signals transmitted on the path in which the compensation coupler is formed.

Here, the plurality of separation couplers may include: a plurality of first couplers that are formed in intersecting paths including an intersecting section at which transmission paths intersect among a plurality of paths between the input coupler and the transmission coupler; and a plurality of second couplers that are formed in intersecting paths including an intersecting section at which transmission paths intersect among a plurality of paths between the transmission coupler and the output coupler.

The plurality of paths may include an intersecting path in which a plurality of the intersecting sections are formed, and the separation couplers may be formed of as many as a number of the intersecting sections in the intersecting path.

More specifically, the plurality of paths may include a first path in which a maximum number of intersecting sections are formed, a second path in which a number of the intersecting paths is less than the maximum number, and a third path in which an intersecting section is not formed.

In this case, compensation couplers may be formed of as many as a difference between the maximum number and a number of corresponding intersecting sections in the second path and the third path, respectively.

DETAILED DESCRIPTION OF THE EMBODIMENTS

Figure 1:
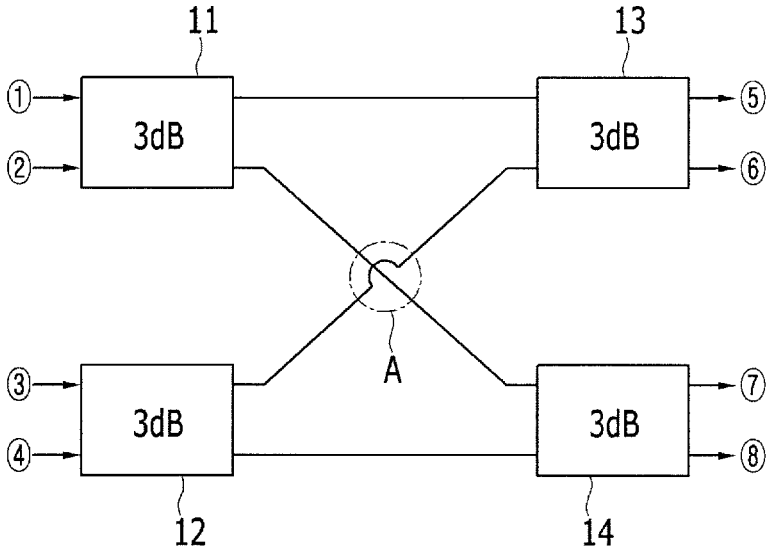
FIG. 1 shows a structure of a general butler matrix.

In the following detailed description, only certain exemplary embodiments of the present invention have been shown and described, simply by way of illustration.

As those skilled in the art would realize, the described embodiments may be modified in various different ways, all without departing from the spirit or scope of the present invention.

Accordingly, the drawings and description are to be regarded as illustrative in nature and not restrictive. Like reference numerals designate like elements throughout the specification.

Through the specification, in addition, unless explicitly described to the contrary, the word "comprise" and variations such as "comprises" or "comprising" will be understood to imply the inclusion of stated elements but not the exclusion of any other elements.

Next, referring to the drawings, a planar type of butler matrix according to an exemplary embodiment of the present invention will be described.

FIG. 1 shows a structure of a general butler matrix.

Here, a structure of a 4×4 butler matrix is described, and all of 4 couplers 11, 12, 13, and 14 are used. Each coupler is a 3 dB coupler that divides an input signal into two signals having half of the power of the input signal and outputs them to two paths, and there is a phase difference of 90° between the two signals respectively outputted to the two paths.

The signal flow in the 4×4 butler matrix will be described.

As shown in FIG. 1, it is assumed that an input signal is fed to the input terminal ① among 4 input terminals.

The input signal is divided into two paths in which a signal has half power of the input signal by a coupler 11, and there is a 90° phase difference between a signal transmitted through one of the paths and a signal transmitted through the other path. Each signal of the two paths is respectively input to the input terminals of couplers 13 and 14 that are connected to the output terminals of the coupler 11.

Two signals respectively input to the couplers 13 and 14 that are connected to the output terminals of the coupler 11 are divided into two paths in which a signal has half power of one's signal and there is a 90° phase difference between them. That is, the signal input to the coupler 13 is output through the terminal ⑤ and the terminal ⑥ of the coupler 13, and the signal input to the coupler 14 is output through the terminal ⑦ and the terminal ⑧ of the coupler 14.

At this time, if there is no path loss due to transmission lines and loss due to a 3 dB coupler, the amplitude of the output signal is −6 dB of the power of the input signal. Also, if there is a little phase difference between transmission lines and a little phase inequality between terminals of a 3 dB coupler, phase delays of an input signal to an output signal may be shown in the following Table 1.

TABLE 1

| Output terminal | Reference point ① | ② | ③ | ④ |
|---|---|---|---|---|
| ⑤ | 0 | 90 | 90 | 180 |
| ⑥ | 90 | 180 | 0 | 90 |
| ⑦ | 90 | 0 | 180 | 90 |
| ⑧ | 180 | 90 | 90 | 0 |

As shown in Table 1, for example, when a reference point (an input terminal) is ①, the phase delays of the output terminals ⑤~⑧ are 0°, 90°, 90°, and 180°, respectively.

For the occurrence of the phase delays as shown in Table 1, phase inequality between hybrid terminals has to be small. This is possible by detailed design and construction. Also, one of elements needed for the phase delay as in Table 1 is the fact that there is no phase difference between a transmission line for connecting the coupler 11 and the coupler 12 positioned at an input end and a transmission line for connecting the coupler 13 and the coupler 14 positioned at an output end. However, as shown in FIG. 1, there is a section A in which the couplers 11 and 12 at the input end are intersected with the couplers 13 and 14 at the output end, and thereby a phase difference occurs.

In an exemplary embodiment of the present invention, to remove the phase difference, a coupler is used in the section at which transmission lines intersect, and a coupler is also used in a path for compensating phase.

Figure 2:
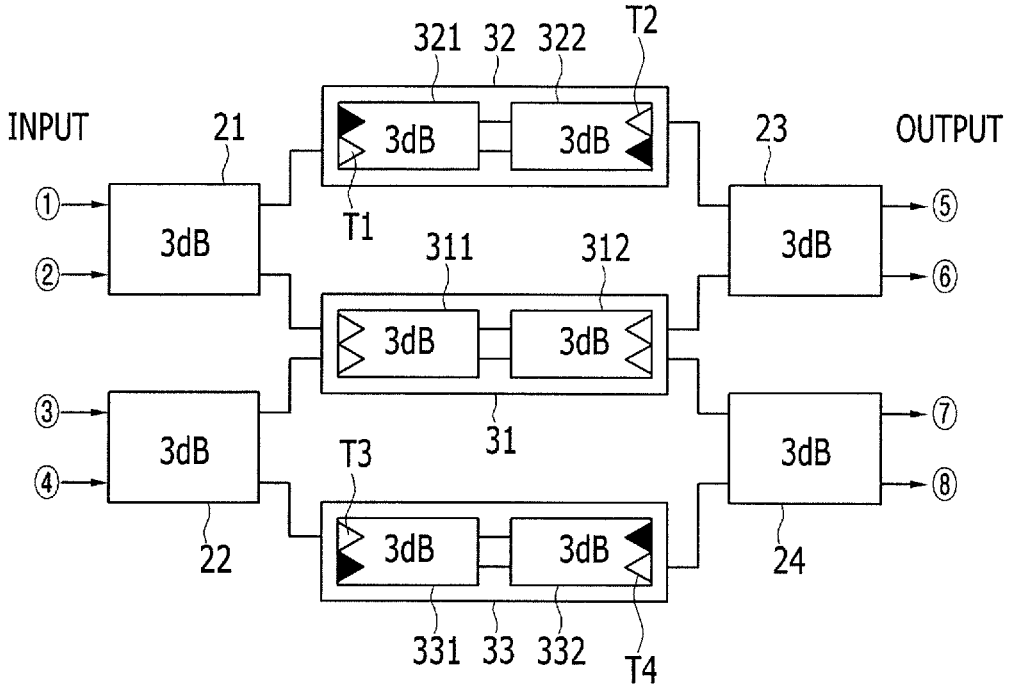
FIG. 2 shows a structure of a butler matrix according to an exemplary embodiment of the present invention.

FIG. 2 shows a structure of a butler matrix according to an exemplary embodiment of the present invention.

The butler matrix according to an exemplary embodiment of the present invention, as shown in FIG. 2, includes couplers 21 and 22 that are positioned at an input end of the butler matrix to receive an input signal and output it to a plurality of paths, and couplers 23 and 24 that are positioned at an output end of the butler matrix to receive a signal input through one among the plurality of paths and output it to another plurality of paths. Here, for better comprehension and ease of description, the couplers positioned at the input end will be referred as to "input couplers", and the couplers positioned at the output end will be referred as to "output couplers".

There are a plurality of paths between the input couplers 21 and 22 and the output couplers 23 and 24, and there is a path at which transmission paths for transmitting a signal intersect, among the plurality of paths. A coupler 31 is positioned at the section at which transmission lines intersect in the path. Couplers 32 and 33 for compensating a phase delay are positioned at other paths excluding the path at which transmission paths intersect from the plurality of paths. Here, for better comprehension and ease of description, the path at which transmission paths intersect from the plurality of paths will be referred as to "an intersecting path", and the coupler positioned at the intersecting path will be referred as to "a separation coupler". Also, a coupler, which is positioned at a path excluding the intersecting path from the plurality of paths for compensating a phase delay between a signal transmitted through the path and a signal transmitted through an intersecting path, will be referred as to "a compensation coupler".

The butler matrix comprised as the above structure basically includes $2^n$ input couplers and $2^n$ output couplers, and there are M input signals and M terminals at the input end and the output end, the M being an integer that is less than or equal to $2^n$. That is, there may be 2 input terminals and 2 output terminals, 4 input terminals and 4 output terminals, or 8 input terminals and 8 output terminals. However, according to an exemplary embodiment of the present invention, the butler matrix is not restricted to include $2^n$ input couplers. For example, the butler matrix may consist of a 3×3 or 6×6 structure. Here, as an example of a 4×4 structure, a butler matrix according to an exemplary embodiment of the present invention will be described.

The butler matrix 1 of 4×4 structure according to an exemplary embodiment of the present invention, as shown in FIG. 2, includes two input couplers 21 and 22 and two output couplers 23 and 24. Each coupler includes two input terminals and two output terminals.

A separation coupler 31 is positioned at an intersecting path among a plurality of paths for connecting an output terminal and an input terminals between the input couplers 21 and 22 and the output couplers 23 and 24. A compensation coupler 32 for compensating a phase delay is positioned at a path between the input coupler 21 and the output coupler 23, excluding an intersecting path among the plurality of paths. Also, another compensation coupler 33 is positioned at a path between the input coupler 22 and the output coupler 24.

More specifically, a path through which a signal from an output terminal of the input coupler 21 is transmitted to an input terminal of the output coupler 24 is intersected with a path through which a signal from an output terminal of the input coupler 22 is transmitted to an input terminal of the output coupler 23. The separation coupler 31 is positioned at the section at which the paths intersect. The compensation coupler 32 for compensating a phase difference with the intersecting path is positioned at a path through which a signal is transmitted from the other output terminal of the input coupler 21 to an input terminal of the output coupler 23. Also, the compensation coupler 33 for compensating a phase difference with the intersecting path is positioned at a path through which a signal is transmitted from the other output terminal of the input coupler 22 to the other input terminal of the output coupler 23.

The separation coupler 31 includes a first coupler 311 for receiving the outputs of the input couplers 21 and 22 as inputs and a second coupler 312 for receiving two outputs of the first coupler 311 as inputs. An output of the second coupler 312 is input to the input terminal of the output coupler 23, and the other output of the second coupler 312 is input to the input terminal of the output coupler 24. The first and second couplers 311 and 312 may be 3 dB couplers, and may form "a 0 dB coupler" of which a signal input to a terminal of the first coupler 311 is output through the second coupler 312 in a direction diagonal to the terminal without loss. A 0 dB coupling means that the amplitude of input signals are coupled as "1". That is, this represents coupling all of input signals. For example, $10*\log_{10}(1)=0$ dB. For this purpose, by connecting two 3 dB couplers in a row, it is possible to form the 0 dB coupling. In an exemplary embodiment of the present invention, the first coupler 311 of a 3 dB coupler combines halves of the amplitudes of input signals and outputs them to two output terminals, and then the second coupler 312 of a 3 dB coupler receives them as inputs. In this case, there is no signal that is output through an output terminal of the second coupler 312 of a 3 dB coupler because of a 180° phase difference, and a signal of "1", that is, a 0 dB signal, is output through the other output terminal of the second coupler 312. At this time, loss may occur as much as transmission loss of a 0 dB coupler.

By the separation coupler 31, a signal output from the input coupler 21 is input to the output coupler 24, and a signal output from the input coupler 22 is input to the output coupler 23.

Therefore, according to an exemplary embodiment of the present invention, without bending a transmission path for transmitting a signal in the intersecting path at which the input couplers 21 and 22 and the output couplers 23 and 24 intersect, it is possible to separate signals by the separation coupler 31.

Meanwhile, the compensation couplers 32 and 33 may form a 0 dB coupler including first and second couplers the same as the separation coupler 31. For this purpose, the compensation coupler 32 includes a first coupler 321 for receiving the output of the input coupler 21 as inputs and a second coupler 322 for receiving two outputs of the first coupler 321 as inputs. Also, the compensation coupler 33 includes a first coupler 331 for receiving the output of the input coupler 22 as inputs and a second coupler 332 for receiving two outputs of the first coupler 331 as inputs.

The compensation couplers 32 and 33 compensate phase differences between signals transmitted by the separation coupler 31 positioned at an intersecting path and signals transmitted through paths excluding the intersecting path. Accordingly, the compensation couplers 32 and 33 receive an input and output it through an output terminal while the separation coupler 31 receives two inputs and outputs them through two output terminals. Therefore, one among two input terminals of the first couplers 321 and 331 consisting of the compensation couplers 32 and 33 is a termination terminal through which a signal is not input and the other is a transmission terminal through which a signal is input. Also, one among two terminals of the second coupler 322 and 332 is a termination terminal through which a signal is not input and the other is a transmission terminal through which a signal is input. In FIG. 2, a termination terminal is shown as black and a transmission terminal through which input/output of a signal is performed is shown as white.

Accordingly, a signal transmitted from the input coupler 21 to the output coupler 23 is input to the transmission terminal T1 of the first coupler 321 of the compensation coupler 32 and then is output through the transmission terminal T2 of the second coupler 322 without loss to input the output coupler 23. Also, a signal transmitted from the input coupler 22 to the output coupler 24 is input to the transmission terminal T3 of the first coupler 331 of the compensation coupler 33 and then is output through the transmission terminal T4 of the second coupler 332 without loss to input the output coupler 24.

Through this process, phase differences between signals separated through the intersecting path and signals not transmitted through the intersecting path can be compensated by electrically separating the signals in the intersecting path with the separation coupler of a 0 dB coupler and by using the compensation couplers 32 and 33 in other paths except for the intersecting path. This allows implementation of transmission paths having the same phase.

Phase characteristics of the butler matrix according to an exemplary embodiment of the present invention will be described.

Figure 3:
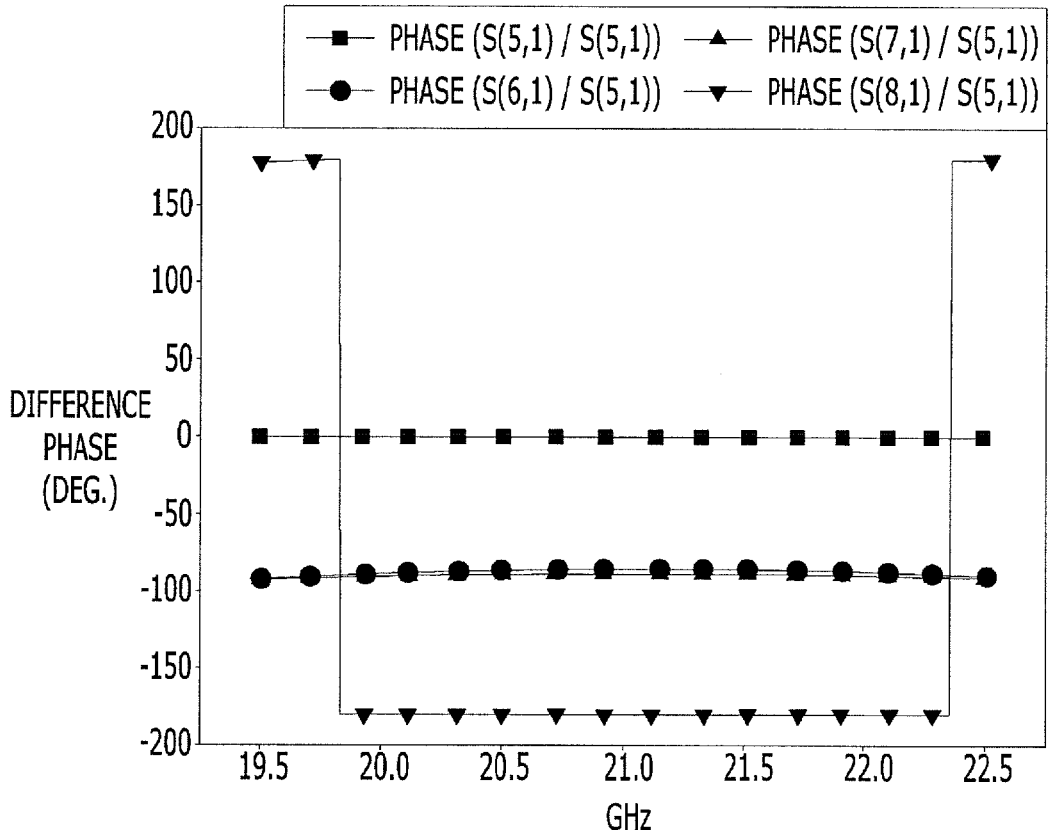
FIG. 3 shows a graph illustrating phase characteristics of a butler matrix according to an exemplary embodiment of the present invention.

FIG. 3 shows a graph illustrating phase characteristics of a butler matrix according to an exemplary embodiment of the present invention. Particularly, FIG. 3 shows phase differences between signals output from the output terminals of the output couplers 23 and 24, that is, terminals ⑤-⑧ when a signal is input to the terminal ① among the input terminals of the input coupler 21 in the butler matrix shown in FIG. 2.

In FIG. 3, the phase S(5.1) of the signal that is input to the terminal ① of the input coupler 21 and then is output through the terminal ⑤ of the output coupler 23 is the phase of the reference path. Through FIG. 3, it is known that phases of signals output through other paths excluding the reference path have the same values as that of the reference path.

Compared with the prior case in which a 0 dB coupler is used in an intersecting path and a phase shifter is used in other paths to compensate a phase difference or the prior case in which the length of transmission path is increased to compensate a phase difference, according to an exemplary embodiment of the present invention, it is possible to compensate phase differences between signals in a easier way by using a 0 dB coupler having a simpler and less expensive structure in a path for compensation. Meanwhile, when the degree of the butler matrix increases, the paths of the transmission lines become more complicated and the number of intersecting paths increases. Since a plurality of 0 dB couplers have to be used in the intersecting paths by the conventional art, a phase shifter having difference phase values has to be used to compensate the phase differences between the transmission lines. However, according to an exemplary embodiment of the present invention, by respectively using a 0 dB coupler in other transmission paths excluding the intersecting path, it is possible to compensate the phase differences in an easier way.

Next, a butler matrix having a higher degree than that of the butler matrix in FIG. 2 according to another exemplary embodiment of the present invention will be described.

Figure 4A:
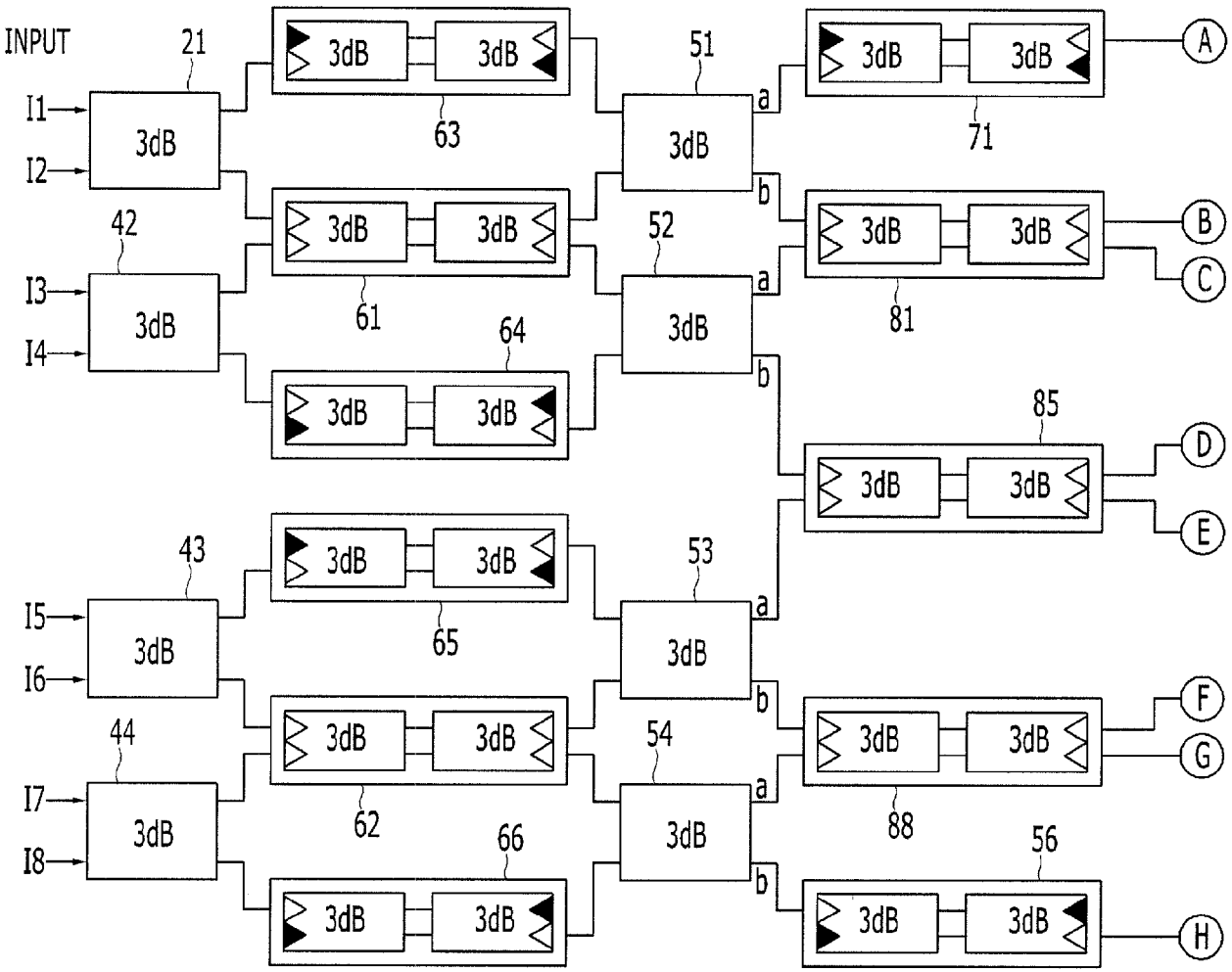
FIGS. 4A and 4B show a structure of a butler matrix according to another exemplary embodiment of the present invention.
Figure 4B:
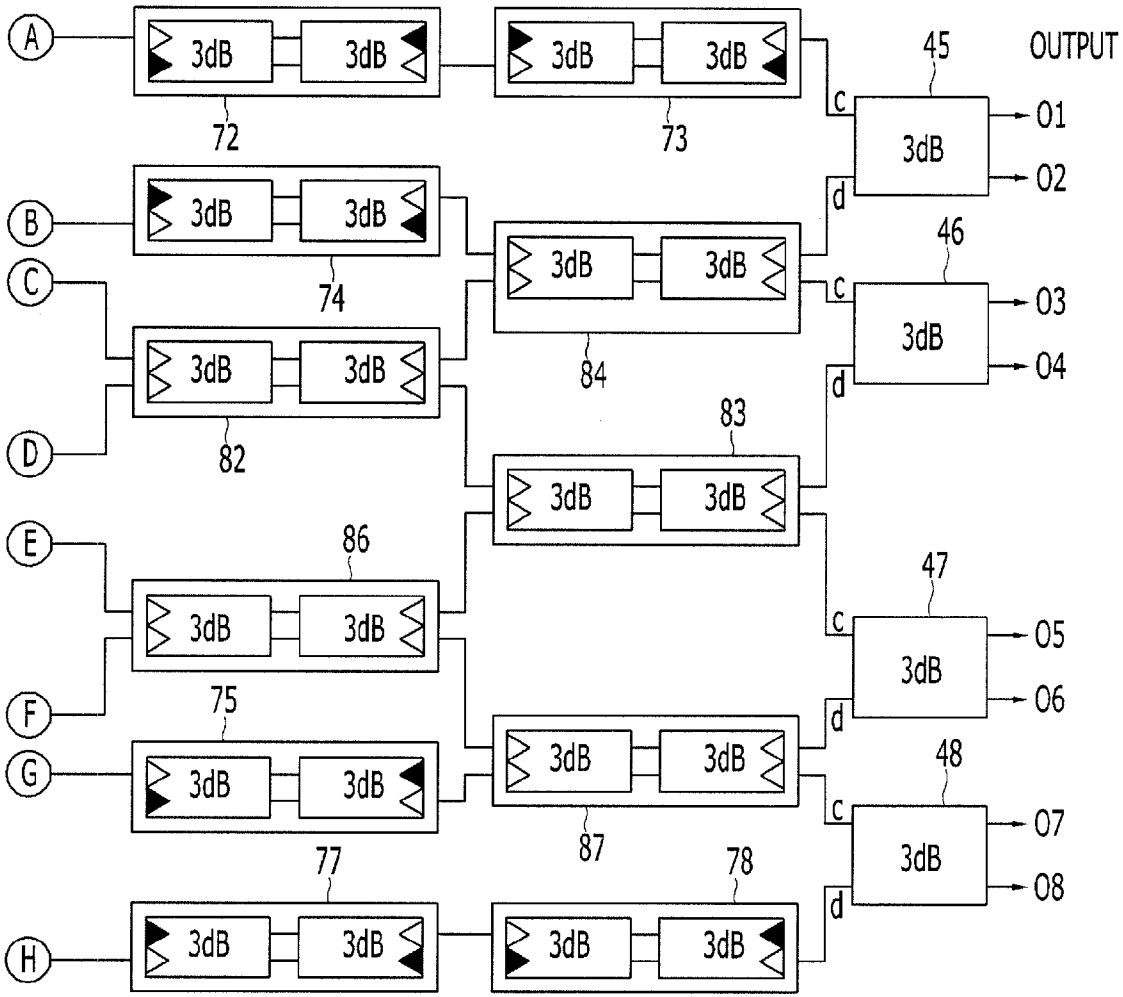
Figure 5:
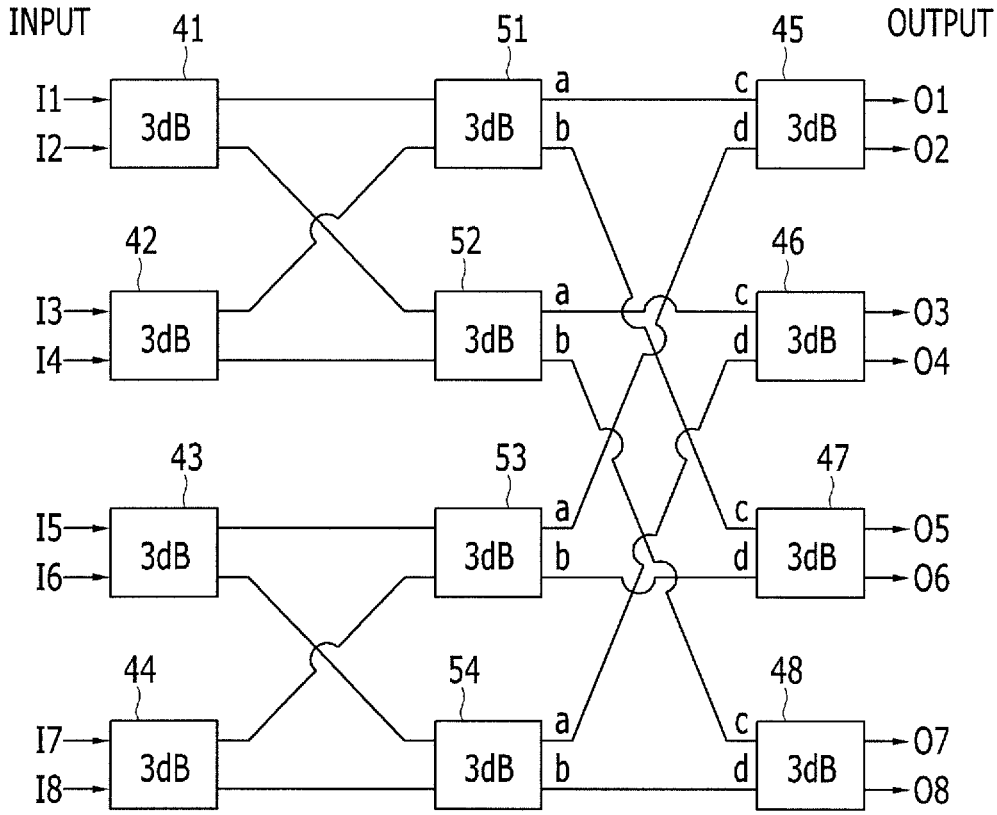
FIG. 5 shows an example of a path through which a signal is transmitted in the butler matrix in FIGS. 4A and 4B.

FIGS. 4A and 4B show a structure of a butler matrix according to another exemplary embodiment of the present invention. FIG. 5 shows an example of a path through which a signal is transmitted in the butler matrix in FIGS. 4A and 4B.

As shown in FIG. 4 and FIG. 5, a butler matrix according to another exemplary embodiment of the present invention has an 8×8 structure, and then signals are input through 8 input terminals at an input end and the input signals are respectively output through 8 output terminals at an output end of the butler matrix.

The butler matrix 2 according to another exemplary embodiment of the present invention as shown in FIGS. 4A and 4B and FIG. 5, includes a plurality of input couplers 41, 42, 43, and 44 that are positioned at the input end of the butler matrix to receive a signal and a plurality of output couplers 45, 46, 47, and 48 that are positioned at the output end of the butler matrix to output a signal. A plurality of transmission couplers 51, 52, 53, and 54 are positioned between the input couplers and the output couplers so that signals respectively input to input terminals 11-18 of the input couplers 41-44 are respectively output through output terminals O1-O8 of the output couplers 45-48. The transmission couplers may increase by stages as the degree of the butler matrix increases. For example, between the transmission couplers 51-54 and the output couplers 45-48, a plurality of transmission couplers may be further used.

Paths that are formed between couplers to transmit signals will be shown as in FIG. 5. When it is assumed that there is no path loss by transmission path, loss by a 3 dB coupler, and phase change in the paths formed as in FIG. 5, phases in each output terminal of the output end on the basis of each input terminal of the input end will be shown as in Table 2.

TABLE 2

| | Reference point | | | | | | | |
|---|---|---|---|---|---|---|---|---|
| Output terminal | ① | ② | ③ | ④ | ⑤ | ⑥ | ⑦ | ⑧ |
| ⑨ | 0 | 90 | 90 | 180 | 90 | 180 | 180 | 270 |
| ⑩ | 90 | 180 | 180 | 270 | 0 | 90 | 90 | 180 |
| ⑪ | 90 | 0 | 180 | 90 | 180 | 90 | 270 | 180 |
| ⑫ | 180 | 90 | 270 | 180 | 90 | 0 | 180 | 90 |
| ⑬ | 90 | 180 | 0 | 90 | 180 | 270 | 90 | 180 |
| ⑭ | 180 | 270 | 90 | 180 | 90 | 180 | 0 | 90 |

TABLE 2-continued

| | Reference point | | | | | | | |
|---|---|---|---|---|---|---|---|---|
| Output terminal | ① | ② | ③ | ④ | ⑤ | ⑥ | ⑦ | ⑧ |
| ⑮ | 180 | 90 | 90 | 0 | 270 | 180 | 180 | 90 |
| ⑯ | 270 | 180 | 180 | 90 | 180 | 90 | 90 | 0 |

There are intersecting paths at which transmission paths intersect in the butler matrix having this phase characteristic as in FIG. 5. Accordingly, in another exemplary embodiment of the present invention, a separation coupler is used in an intersecting path among a plurality of paths between the input end and the output end, and a compensation coupler is used in other paths excluding the intersecting path so that phase differences between the intersecting path and the other paths are compensated by electrically separating signals in the intersecting path.

In the butler matrix of an 8×8 structure in FIGS. 4A and 4B and FIG. 5, between the input couplers 41-44 and the transmission couplers 51-54, there are intersecting paths at which a transmission path intersects with another transmission path and paths at which transmission paths do not intersect. However, between the transmission couplers 51-54 and the output couplers 44-48, there is an intersecting path at which a transmission path intersects with a plurality of transmission paths.

For example, a transmission path between the transmission coupler 51 and the output coupler 47 intersects with a transmission path between the transmission coupler 52 and the output coupler 46 and a transmission path between the transmission coupler 54 and the output coupler 46, respectively. Accordingly, to input a signal output from an input terminal of the transmission coupler 51 to an input terminal of the output coupler 47, the signal has to be electrically separated from a signal output through a different transmission path while passing three separation couplers. Also, in the transmission path in which a signal is transmitted from a transmission coupler to an output coupler without passing a separation coupler, three compensation couplers are needed for compensating phase delays with the three separation couplers.

Meanwhile, a transmission path between the transmission coupler 52 and the output coupler 46 intersects with a transmission path between a transmission coupler 51 and the output coupler 47 and a transmission path between the transmission coupler 53 and the output coupler 45, respectively. Accordingly, to input a signal output from an input terminal of the transmission coupler 52 to an input terminal of the output coupler 46, the signal has to be electrically separated from a signal output through a different transmission path while passing two separation couplers.

As above, a transmission path intersects with three different transmission paths or two different transmission paths, and thereby phase delay occurs between the transmission path at which the three separation couplers are positioned and the transmission path at which the two separation couplers are positioned. Accordingly, a compensation coupler is needed to compensate a phase delay between the transmission paths. Therefore, a compensation coupler is used between the transmission coupler 52 and the output coupler 46. As above, in a path in which there is no intersecting path, compensation couplers of as many as the maximum number of the intersecting paths are formed to compensate phase delays with a path in which there are the maximum number of the intersecting paths. Further, in a path in which there are intersecting paths, separation couplers as many as the number of the intersecting paths are formed and couplers of as many as the maximum number of the intersecting paths are formed to compensate phase delays with a path in which there are the maximum number of the intersecting paths.

Accordingly, as shown in FIG. 4, in the butler matrix 2 according to an exemplary embodiment of the present invention, separation couplers 61, 62, and 63 are respectively formed in the intersecting paths between the input couplers 41-44 and the transmission couplers 51-54. Further, compensation couplers 63, 64, 65, and 66 are respectively formed in other paths excluding the intersecting paths between the input couplers 41-44 and the transmission couplers 51-54.

Meanwhile, between the transmission couplers 51-54 and the output couplers 45-48, a plurality of separation couplers are used according to the number of intersecting sections formed in each path, and at least one compensation coupler is used according to the difference between the number of intersecting sections formed in a corresponding path and the maximum number of the intersecting sections.

More specifically, there is no section at which transmission paths intersect in the path between an output terminal (a) of the transmission coupler 51 and an input terminal (c) of the output coupler 45, and then three compensation couplers 71, 72, and 73 are formed in the path. Also, three separation couplers 81, 82, and 83 are formed in the path between an output terminal (b) of the transmission coupler 51 and an input terminal (c) of the output coupler 47.

A separation coupler 81, a compensation coupler 74, and a separation coupler 84 are positioned at the path between an output terminal (a) of the transmission coupler 52 and an input terminal (c) of the output coupler 46. In addition, three separation couplers 85, 86, and 87 are positioned at the path between an output terminal (b) of the transmission coupler 51 and an input terminal (c) of the output coupler 48.

Further, three separation couplers 85, 82, and 84 are positioned at the path between an output terminal (a) of the transmission coupler 53 and an input terminal (d) of the output coupler 45. Further, a separation coupler 88, a compensation coupler 75, and a separation coupler 87 are positioned at the path between an output terminal (b) of the transmission coupler 53 and an input terminal (c) of the output coupler 47.

Also, three separation couplers 88, 86, and 83 are positioned at the path between an output terminal (a) of the transmission coupler 55 and an input terminal (d) of the output coupler 46. Three compensation couplers 76, 77, and 78 are positioned at the path between an output terminal (b) of the transmission coupler 55 and an input terminal (d) of the output coupler 48.

In FIG. 4, the separation couplers 61, 62, and 81-88 and the compensation couplers 63-66 and 71-78 are 0 dB couplers including two couplers as the same as in FIG. 2. Each of the compensation couplers 63-66 and 71-78 includes a termination terminal through which a signal is not input/output and a transmission terminal through which a signal is input/output.

Through the butler matrix of this structure, a signal input through one among input terminals at the input end is electrically separated from others in different transmission paths by passing separation couplers and then may be output through one among output terminals at the output end without phase delays.

Phase characteristics of the butler matrix having the above structure according to another exemplary embodiment of the present invention will now be described.

Figure 6:
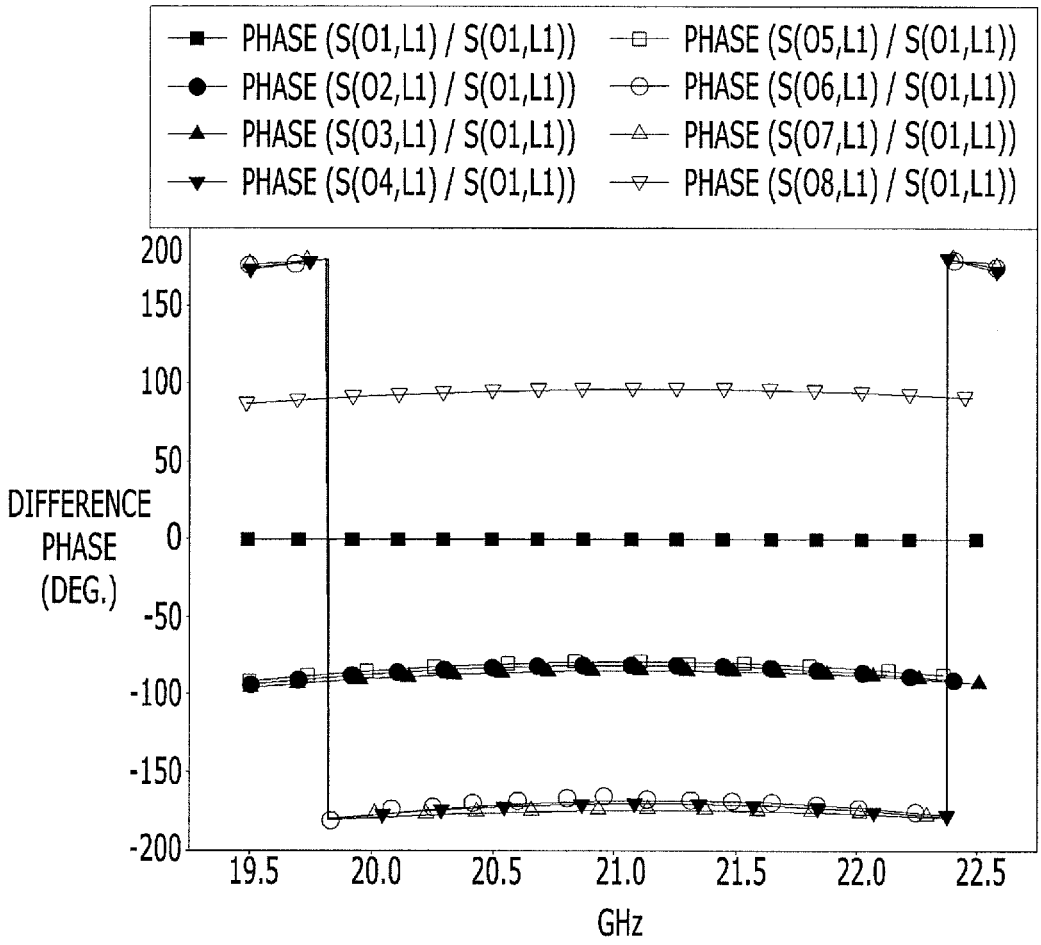
FIG. 6 shows a graph illustrating phase characteristics of the butler matrix in FIGS. 4A and 4B according to another exemplary embodiment of the present invention.

FIG. 6 shows a graph illustrating phase characteristics of the butler matrix in FIGS. 4A and 4B according to another exemplary embodiment of the present invention. FIG. 6 shows phase differences between signals output from the output terminals O1-O8 of the output couplers 45-48 when a signal is input to the input terminal 11 of the input coupler 41 in the butler matrix shown in FIG. 4.

The phase S(O1, I1) of the signal that is input to the input terminal I1 of the input coupler 21 and then is output through the output terminal O1 of the output coupler 45 becomes a phase of a reference path in FIG. 6. Through FIG. 6 it is known that phases of signals output through the remaining paths excluding the reference path have the same value as that of the reference path.

According to the exemplary embodiments of the present invention, the butler matrix may have a planar type of structure or a structure in which a plurality of layers are laminated.

Also, the butler matrix according to the exemplary embodiments of the present invention may used in a multiple terminal amplifier or a phase array antenna, or others. The transmission path through which a signal is transmitted may be realized in many forms of a micro-strip line, a strip line, a coaxial line, a wave guide, or others.

Also, a separation coupler is replaced with a path at which transmission paths intersect, thereby the butler matrix will be realized to have a more simple structure. In addition, compensation couplers are formed in other paths excluding the intersecting path, and thereby it is possible to compensate a phase change between the intersecting path and the other paths. Accordingly, amplitude and phase characteristics between transmission paths may be stably maintained.

The above-mentioned exemplary embodiments of the present invention are not embodied only by an apparatus and method. Alternatively, the above-mentioned exemplary embodiments may be embodied by a program performing functions that correspond to the configuration of the exemplary embodiments of the present invention, or a recording medium on which the program is recorded.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A butler matrix comprising:

a plurality of input couplers that are positioned at an input end of the butler matrix, receive an input signal, and divide and output it to a plurality of paths;

a plurality of output couplers that receive a signal from the input coupler and divide the signal into a plurality of paths to output it as an output signal;

a plurality of transmission couplers that are respectively formed between the plurality of input couplers and the plurality of output couplers to transmit a signal output from the input coupler to the output coupler;

a plurality of separation couplers that are respectively formed in intersecting paths including an intersecting section at which transmission paths intersect among a plurality of paths through which a signal is transmitted between the input coupler and the output coupler, and separate signals transmitted through different transmission paths; and a plurality of compensation couplers that compensate phase delays with signals transmitted on the path in which the compensation coupler is formed, wherein the plurality of separation couplers comprise:

a plurality of first couplers that are formed in intersecting paths including an intersecting section at which transmission paths intersect among a plurality of paths between the input coupler and the transmission coupler; and a plurality of second couplers that are formed in intersecting paths including an intersecting section at which transmission paths intersect among a plurality of paths between the transmission coupler and the output coupler.

2. The butler matrix of claim 1, wherein the plurality of paths include an intersecting path in which a plurality of the intersecting sections are formed, and the separation couplers are formed of as many as a number of the intersecting sections in the intersecting path.

3. The butler matrix of claim 2, wherein the plurality of paths include a first path in which a maximum number of intersecting sections are formed, a second path in which a number of the intersecting paths is less than the maximum number, and a third path in which an intersecting section is not formed, and compensation couplers are formed of as many as a difference between the maximum number and a number of corresponding intersecting sections in the second path and the third path, respectively.

4. The butler matrix of claim 1, wherein the butler matrix has a planar type of structure.

5. The butler matrix of claim 1, wherein the butler matrix is used in a multiple terminal amplifier.

6. A butler matrix comprising:

at least one input coupler that is positioned at an input end of the butler matrix, receives an input signal, and divides and outputs it to a plurality of paths;

at least one output coupler that receives a signal from the input coupler and divides the signal into a plurality of paths to output it as an output signal;

a separation coupler that is formed in an intersecting path including a intersecting section at which transmission paths intersect among a plurality of paths through which a signal is transmitted between the input coupler and the output coupler, and separates signals transmitted through different transmission paths; and a compensation coupler that is formed in a path excluding the intersecting path among the plurality of paths and compensates a phase difference between a signal transmitted through the intersecting path and a signal transmitted through the path excluding the intersecting path, Wherein the separation coupler includes a first coupler having a plurality of input terminals and a plurality of output terminals and a second coupler having a plurality of output terminals and a plurality of input terminals that are respectively connected with the output terminals of the first coupler.

7. The butler matrix of claim 6, wherein a number of separation couplers used in the intersecting path is based on a number of intersecting sections formed in the intersecting path.

8. The butler matrix of claim 7, wherein a number of compensation couplers used in the path excluding the intersecting path is based on the number of separation couplers formed in the intersecting path.

9. The butler matrix of claim 6, wherein the separation coupler is a 0 dB coupler, and the input coupler and output coupler are 3 dB couplers.

10. A butler matrix comprising:

a plurality of input couplers that are positioned at an input end of the butler matrix, receive an input signal, and divide and output it to a plurality of paths;

a plurality of output couplers that receive a signal from the input coupler and divide the signal into a plurality of paths to output it as an output signal;

a plurality of transmission couplers that are respectively formed between the plurality of input couplers and the plurality of output couplers to transmit a signal output from the input coupler to the output coupler;

a plurality of separation couplers that are respectively formed in intersecting paths including an intersecting section at which transmission paths intersect among a plurality of paths through which a signal is transmitted between the input coupler and the output coupler, and separate signals transmitted through different transmission paths; and a plurality of compensation couplers that compensate phase delays with signals transmitted on the path in which the compensation coupler is formed, wherein the separation coupler includes a first coupler having a plurality of input terminals and a plurality of output terminals and a second coupler having a plurality of output terminals and a plurality of input terminals that are respectively connected with the output terminals of the first coupler.

11. The butler matrix of claim 6, wherein the butler matrix has a planar type of structure.

12. The butler matrix of claim 6, wherein the butler matrix is used in a multiple terminal amplifier.

13. The butler matrix of claim 10, wherein the separation coupler is a 0 dB coupler, and the input coupler and output coupler are 3 dB couplers.

14. A butler matrix comprising:

at least one input coupler that is positioned at an input end of the butler matrix, receives an input signal, and divides and outputs it to a plurality of paths;

at least one output coupler that receives a signal from the input coupler and divides the signal into a plurality of paths to output it as an output signal;

a separation coupler that is formed in an intersecting path including a intersecting section at which transmission paths intersect among a plurality of paths through which a signal is transmitted between the input coupler and the output coupler, and separates signals transmitted through different transmission paths; and a compensation coupler that is formed in a path excluding the intersecting path among the plurality of paths and compensates a phase difference between a signal transmitted through the intersecting path and a signal transmitted through the path excluding the intersecting path, wherein the compensation coupler includes a first coupler having a plurality of input terminals and a plurality of output terminals and a second coupler having a plurality of output terminals and a plurality of input terminals that are respectively connected with the output terminals of the first coupler, and one among the plurality of input terminals of the first coupler is a termination terminal through which a signal is not input, and one among the plurality of output terminals of the second coupler is a termination terminal through which a signal is not output.

15. The butler matrix of claim 14, wherein the compensation coupler is a 0 dB coupler, and the input coupler and output coupler are 3 dB couplers.

16. A butler matrix comprising:

a plurality of input couplers that are positioned at an input end of the butler matrix, receive an input signal, and divide and output it to a plurality of paths;

a plurality of output couplers that receive a signal from the input coupler and divide the signal into a plurality of paths to output it as an output signal;

a plurality of transmission couplers that are respectively formed between the plurality of input couplers and the plurality of output couplers to transmit a signal output from the input coupler to the output coupler;

a plurality of separation couplers that are respectively formed in intersecting paths including an intersecting section at which transmission paths intersect among a plurality of paths through which a signal is transmitted between the input coupler and the output coupler, and separate signals transmitted through different transmission paths; and a plurality of compensation couplers that compensate phase delays with signals transmitted on the path in which the compensation coupler is formed, wherein the compensation coupler includes a first coupler having a plurality of input terminals and a plurality of output terminals and a second coupler having a plurality of output terminals and a plurality of input terminals that are respectively connected with the output terminals of the first coupler, and one among the plurality of input terminals of the first coupler is a termination terminal through which a signal is not input, and one among the plurality of output terminals of the second coupler is a termination terminal through which a signal is not output.

17. The butler matrix of claim 16, wherein the compensation coupler is a 0 dB coupler, and the input coupler and output coupler are 3 dB couplers.

* * * * *